US009016264B2

(12) United States Patent
Stockner

(10) Patent No.: US 9,016,264 B2
(45) Date of Patent: Apr. 28, 2015

(54) CRYOGENIC FUEL SYSTEM HAVING A PRIMING CIRCUIT

(71) Applicant: Caterpillar Inc., Peoria, IL (US)

(72) Inventor: Alan Ray Stockner, Metamora, IL (US)

(73) Assignee: Caterpillar Inc., Peoria, IL (US)

( * ) Notice: Subject to any disclaimer, the term of this patent is extended or adjusted under 35 U.S.C. 154(b) by 272 days.

(21) Appl. No.: 13/665,201

(22) Filed: Oct. 31, 2012

(65) Prior Publication Data

US 2014/0116396 A1 May 1, 2014

(51) Int. Cl.

| | |
|---|---|
| ***F02M 21/02*** | (2006.01) |
| ***F02M 31/20*** | (2006.01) |
| ***F02M 59/36*** | (2006.01) |
| ***F02D 41/00*** | (2006.01) |

(52) U.S. Cl.

CPC ..... *F02M 31/20* (2013.01); *F02M 59/36* (2013.01); *F02M 59/366* (2013.01); *F02D 41/003* (2013.01); *F02D 41/0027* (2013.01)

(58) Field of Classification Search

CPC ..... F02M 31/20; F02M 59/36; F02M 59/366; F02D 41/0027; F02D 41/003

USPC ..... 123/495, 27 GE, 515–527, 540, 541

See application file for complete search history.

(56) References Cited

U.S. PATENT DOCUMENTS

| | | | | |
|---|---|---|---|---|
| 2,985,161 | A * | 5/1961 | Seegrist | 123/179.11 |
| 5,415,001 | A * | 5/1995 | Powars | 62/50.2 |
| 5,431,546 | A | 7/1995 | Rhoades | |
| 6,286,320 | B1 | 9/2001 | Riche et al. | |
| 7,021,341 | B2 * | 4/2006 | Viegas et al. | 141/82 |
| 7,083,395 | B2 | 8/2006 | Maiefski et al. | |
| 7,584,623 | B2 * | 9/2009 | Spittael et al. | 62/50.3 |
| 8,590,612 | B2 * | 11/2013 | Shampine | 166/90.1 |
| 2002/0157402 | A1 * | 10/2002 | Drube et al. | 62/50.1 |
| 2010/0252686 | A1 * | 10/2010 | Raymond et al. | 244/172.2 |

* cited by examiner

*Primary Examiner* — Mahmoud Gimie

(74) *Attorney, Agent, or Firm* — Finnegan, Henderson, Farabow, Garrett & Dunner, LLP

(57) ABSTRACT

A cryogenic fuel system having a priming circuit for a machine is disclosed. The fuel system may have a tank, configured to hold a cryogenic fluid, and a pump. A first passage may connect the tank and the pump, and a second passage may be configured to hold a cooling fluid and be located to cool the first passage.

17 Claims, 3 Drawing Sheets

CRYOGENIC FUEL SYSTEM HAVING A PRIMING CIRCUIT

TECHNICAL FIELD

The present disclosure relates generally to a fuel system, and more particularly, to a cryogenic fuel system having a priming circuit.

BACKGROUND

A motor vehicle, such as a mining truck, can be equipped with a liquefied natural gas (LNG) pump that fuels an engine of the truck. When the truck is in use, and the pump is active, the pump pushes LNG from an associated tank into the engine. During periods of nonuse, LNG is no longer drawn through the pump.

LNG is a fuel that has been cooled to about −160° C. Therefore, a pump that has been inactive for an extended period of time is devoid of this cold fuel and warms to ambient temperatures. The pump is then required to be primed, and thereby cooled, before the engine may be started. Priming an LNG pump traditionally involves flooding the pump with LNG or a separate coolant to cool the pump. However, introducing LNG to a warm pump can cause the LNG to boil during the priming process. This boiling releases an unwanted gaseous build-up at the pump inlet or in the pump itself, causing it to be "vapor locked." The pump then requires additional cooling time to liquify the vapor before the pump is ready to perform. Introducing a separate coolant involves the extra step of removing the coolant from the system and disposing of it before the LNG can be pumped from the tank.

One attempt to avoid gaseous build-up in an LNG pump during priming is to connect the pump to a vapor dome collector that sits above the pump. In this configuration, any gaseous release naturally flows up and into the vapor dome collector, allowing only LNG to flow down and into the pump. The gas vapor may then be directed back into the tank, securely away from the pump. One such system is described in U.S. Pat. No. 5,431,546 (the '546 patent) by Rhoades, issued on Jul. 11, 1995.

Although the '546 patent may allow the pump to be primed without risk of vapor lock, the system may be wasteful, expensive, and incapable of safely venting. In particular, when using the system disclosed in the '546 patent, an amount of LNG may be boiled and converted into gas, which is of no use when priming a pump. Additionally, LNG may be expensive for use as a coolant, especially when LNG is boiled and therefore wasted. LNG released into the atmosphere, from the vapor dome collector and/or tank, may constitute an environmental and safety hazard. LNG may evaporate and form a flammable vapor cloud that can explode. Therefore, a user may not want to vent LNG into the atmosphere, especially when working in a shop or other closed environment.

The disclosed system is directed to overcoming one or more of the problems set forth above and/or other problems of the prior art.

SUMMARY

In one aspect, the present disclosure is directed to a fuel priming system that includes a tank configured to hold a cryogenic fuel, a pump, a first passage connecting the tank and the pump, and a second passage configured to hold a cooling fluid and located to cool the first passage.

In another aspect, the present disclosure is directed to a method of cooling a pump. The method includes releasing fuel from a tank into a warmed passage, allowing the fuel to expand within the warmed passage, directing the expanding fuel from the warmed passage toward the pump, and directing cooling fluid into a second passage to cool the warmed passage.

DETAILED DESCRIPTION

Figure 1:
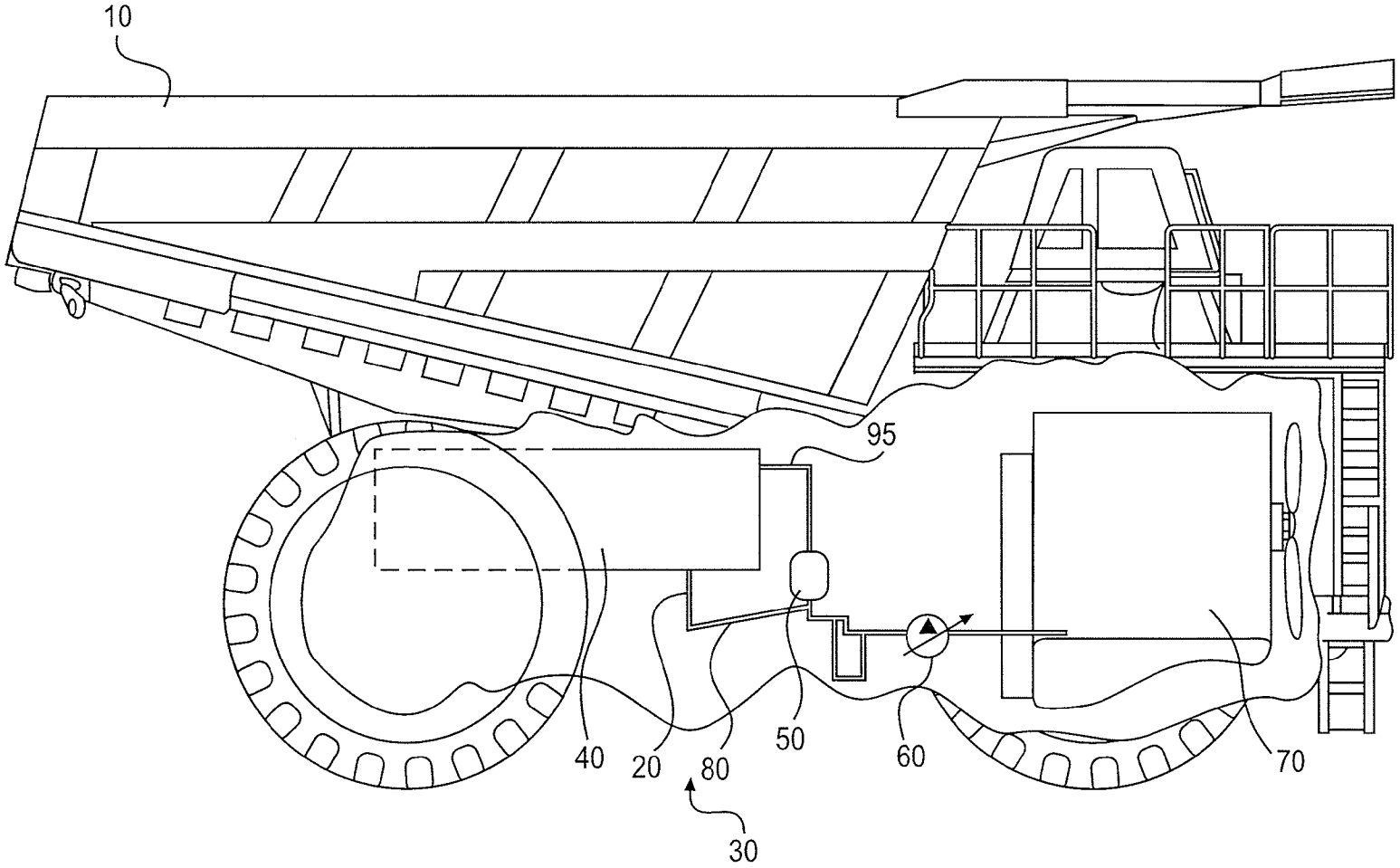
FIG. 1 is a diagrammatic and schematic illustration of an exemplary disclosed machine.

FIG. 1 illustrates an exemplary disclosed machine 10 having a fuel system 30. The machine 10 may be mobile or stationary and configured to perform mining, construction, farming, transportation, power generation, or any other work associated with a particular industry. In the embodiment of FIG. 1, machine 10 is a mining truck. In another embodiment, machine 10 may be an off-highway truck, a dozer, a backhoe, an excavator, a motor grader, or any other earth moving machine. The machine 10 may alternatively be a stationary machine including, but not limited to, a stationary generator set, pumping mechanism, or other suitable operation-performing machine.

The fuel system 30 may form a fuel priming system including a priming circuit 20 connecting a tank 40 with a pump 60 and a vapor dome collector 50 by way of a first conduit 80 and a second conduit 95. The fuel system 30 may be located within the machine 10 and connected to an engine 70 of the machine 10 to supply the engine 70 with cryogenic fuel. As shown in FIG. 1, the fuel system 30 is within the body of the machine 10, but the fuel system 30 may be located exterior to, below, or above the machine 10 if desired. For example, the fuel system 30 may be towed behind machine 10.

Figure 2:
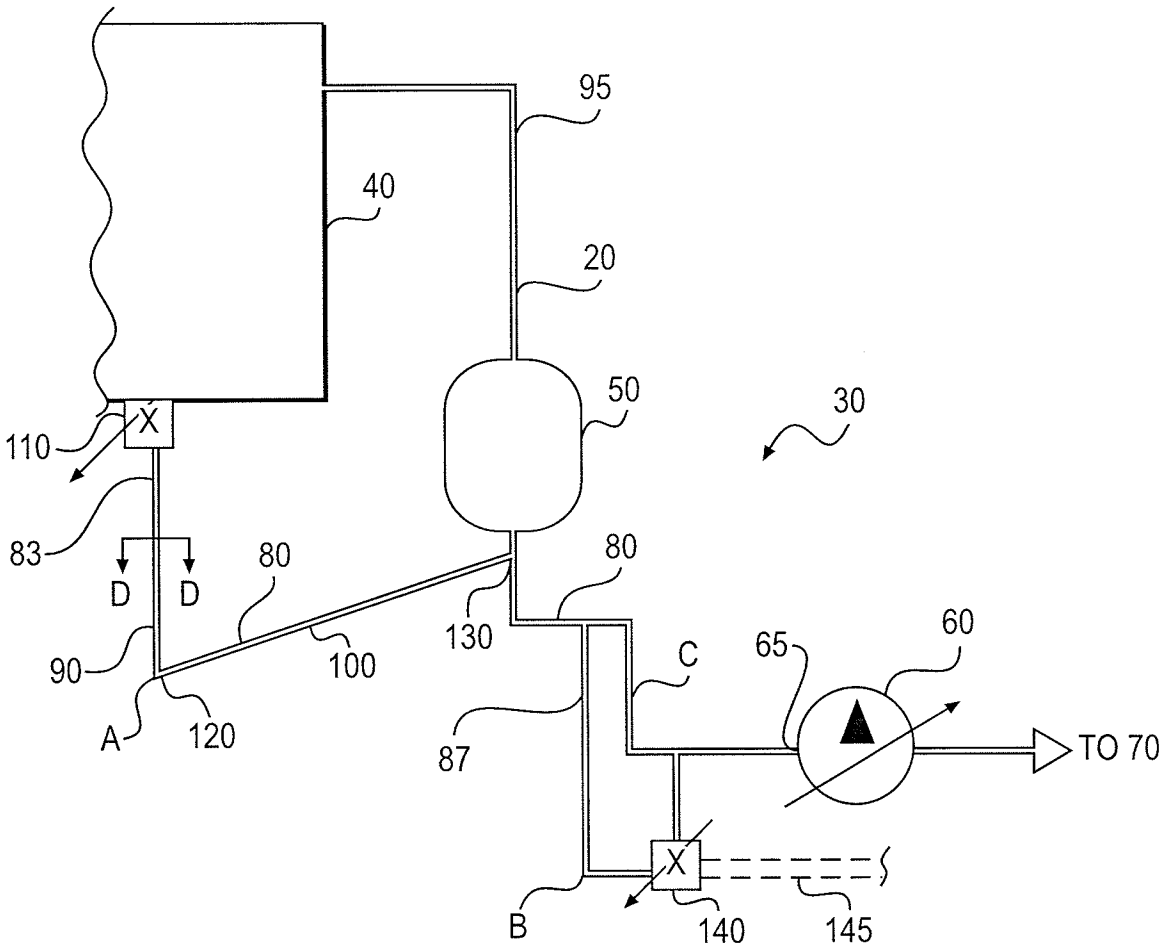
FIG. 2 is a schematic illustration of an exemplary disclosed cryogenic fuel system having a priming circuit that may be used with the machine of FIG. 1.

FIG. 2 is a schematic illustration of the fuel system 30 of FIG. 1. The tank 40 may be configured to hold liquid fuel for the engine 70, specifically a cryogenic fuel and/or gas vapor. Specifically, in one exemplary embodiment, the tank 40 is configured to hold liquid fuel at the bottom portion of the tank 40 and vapor gas at the top. In one exemplary embodiment, the cryogenic fuel includes liquefied natural gas (LNG). The pump 60 may be configured to pressurize and direct the fuel toward the engine 70, and may be of any conventional design, for example, a centrifugal pump or a piston pump. The fuel may be gasified prior to or while entering the engine 70, such that the engine 70 combusts only gaseous fuel. Alternatively, the fuel may be gasified after passing though pump 60.

The vapor dome collector 50 may be located between the tank 40 and the pump 60. The vapor dome collector 50 may be of sufficient size and material to collect gaseous boil off from priming circuit 20 formed within the first conduit 80. Specifically, the vapor dome collector 50 may include a large interior configured to collect vapor gas in an upper portion and liquid fuel in a bottom portion. The exterior may be insulated to safely hold the liquid fuel. Several sensors and valves (not shown) may be located within the vapor dome collector 50, including a liquid level sensor, a pressure sensor, a vapor check valve, and a liquid check valve to regulate the amount of vapor gas and fuel in the vapor dome collector 50.

The first conduit 80, which may connect the tank 40 to the pump 60, may include an upstream portion 83 and a downstream portion 87, relative to the vapor dome collector 50. A vertical section 90 of the upstream portion 83 may extend a sufficient distance from the tank 40 to allow fluid within the tank 40 to be drawn by gravity downward at a desired rate, when vent 110 is open. Vent 110 connects the first conduit 80 to the tank 40 and selectively opens and closes. In one exemplary embodiment, the vent 110 is positioned on a bottom surface of the tank 40.

At a location A, the upstream portion 83 of the first conduit 80 may transition from the vertical section 90 to an inclined section 100. Therefore, location A may form an outlet for the vertical section 90. Location A may be a distinct point, as shown in FIG. 2, or may form a gradual transition (not shown). The inclined section 100 may extend a predetermined distance, having a first end 120, at location A, and a second end 130. The second end 130 may be gravitationally higher than the first end 120, such that a longitudinal axis of the inclined section 100 is oblique to a longitudinal axis of the vertical section 90.

The second end 130 of the upstream portion 83 of the first conduit 80 may connect to the vapor dome collector 50 and to pump 60 in parallel via downstream portion 87, allowing the first conduit 80 to be in fluid communication with each of the tank 40, vapor dome collector 50, and pump 60. As also shown in FIG. 2, the downstream portion 87 of the first conduit 80 may continue from the vapor dome collector 50 and divide into branches B and C. Branch B may connect the vapor dome collector 50 to a valve 140, and branch C may connect the vapor dome collector 50 to an inlet 65 of pump 60 and to valve 140. The branches B, C may form a continuous pathway for fluid traveling within the first conduit 80.

Figure 3:
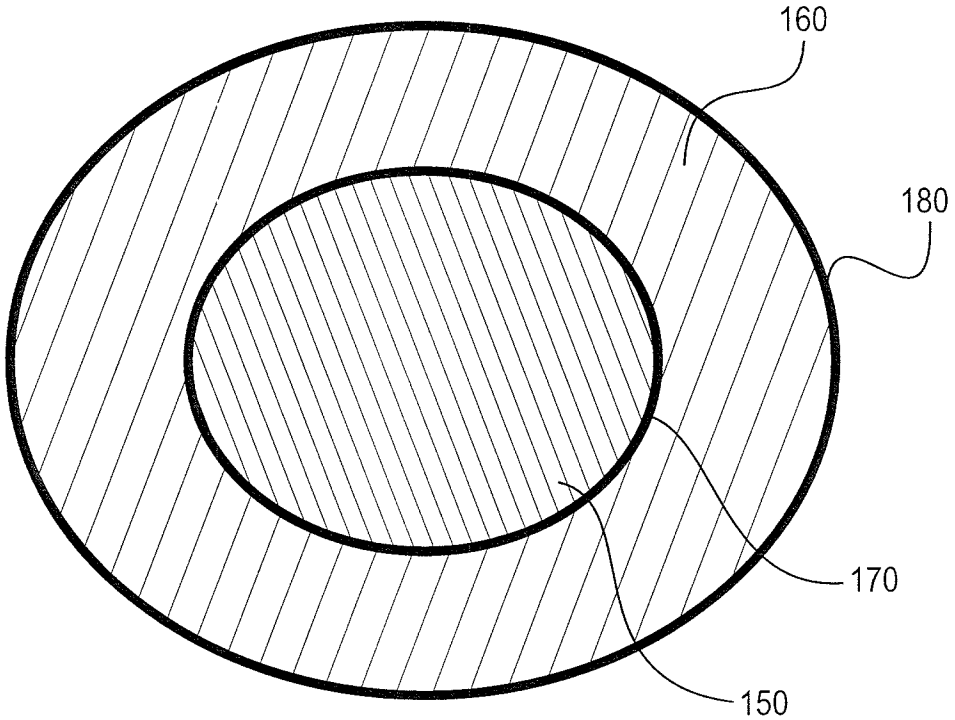
FIG. 3 is a cross-sectional illustration of a fluid passage that may be used with the fuel system of FIG. 1.

FIG. 3 is a cross section of the first conduit 80 at location D-D shown in FIG. 2. As shown in this cross-section, a second passage 160 may be located to cool a first passage 150. In one exemplary embodiment, the first and second passages 150, 160 are coaxial. A cooling jacket 170 may encase and surround the first passage 150. Therefore, the first passage 150 may be configured to pass LNG from the tank 40 to the pump 60. The second passage 160 may be encased and surrounded by a layer of insulation 180 and configured to pass a cooling fluid, not limited to liquid nitrogen or LNG, that is re-circulated from the pump 60 back toward the tank 40.

The first and second passages 150, 160 may be in fluid communication with the tank 40, vapor dome collector 50, pump 60, vent 110, and valve 140. Vent 110 may be of any vent configuration known in the art, and moveable between at least two distinct positions. When in the first position, the vent 110 connects the second passage 160 to the atmosphere, and when in the second position, the vent 110 connects the second passage 160 to tank 40. Vent 110 may be selectively moveable between the first and second positions during a priming event based on the type of cooling fluid passing through the second passage 160.

Valve 140 may be of any configuration know in the art, and may be connected to the first and second passages 150, 160 at the pump 60. In one exemplary embodiment, valve 140 may include a solenoid valve, and in another embodiment it may include a manual valve. The valve 140 may further be selectively moveable between at least two distinct positions. When in the first position, the valve 140 may direct cooling fluid, from an optional coolant supply 145, into the second passage 160, and when in the second position it may redirect fuel from the first passage 150 into the second passage 160. Specifically, valve 140 may be configured to selectively connect a cooling fluid, for example liquid nitrogen or another cooling fluid, with the second passage 160 so that the cooling fluid in the second passage 160 cools the first passage 150. Additionally, the valve 140 may be configured to selectively re-circulate fuel so that the fuel in the second passage 160 cools the first passage 150. The optional coolant supply 145 may forcibly or passively transport the cooling fluid through valve 140 into the second passage 160.

INDUSTRIAL APPLICABILITY

The disclosed fuel system may provide at least two ways to prime and cool a fuel pump of a machine. The first option may allow for cooling fluid to be introduced into the system and vented, and the second option may allow for where fuel is re-circulated within the system. In an exemplary embodiment, a user of the machine may selectively switch between the first and second methods. Operation of the fuel system will now be described in detail.

As illustrated in FIG. 2, after the pump 60 has been idle for an extended period of time, but suddenly called up for operation, the liquid fuel may be released from the tank 40 and into the first passage 150 of the first conduit 80 by gravity. Therefore, a gravitational pull may cause the fuel to move downward into the vertical section 90. The first conduit 80, including the first passage 150, may be warm at this time due to the inactivity of the pump 60. For purposes of this disclosure, a warmed passage may be defined as a passage that is warmer than the fuel supply. The warmed first passage 150 allows the fuel to expand when it enters the vertical section 90 of the warmed first conduit 80. The expanding fuel, driven by thermal expansion, may then be directed within the warmed first passage 150 from the upstream portion 83, through the downstream portion 87, and toward pump 60.

Vapor gas that is produced from the expanding fuel within the first conduit 80, may be collected within the vapor dome collector 50. Second end 130 of the inclined section 100, being gravitationally higher than the first end 120, may allow the vapor gas to easily rise into the vapor dome collector 50. Furthermore, vapor gas within the downstream portion 87 may rise into the vapor dome collector 50 via branches B and C. The vapor gas may flow from the vapor dome collector 50, through the second conduit 95, and back into the tank 40 as shown in FIG. 2. Thus the second conduit 95 may extend from the vapor dome collector 50 and form a passage from the vapor dome collector 50 to a top portion of the tank 40. Within the tank 40, the vapor gas may rise to the top of the tank 40, allowing the LNG fuel to be positioned at the bottom of the tank 40.

While the fuel flows toward pump 60, a cooling fluid may be selectively introduced into the second passage 160 via valve 140. Specifically, the cooling fluid may be directed into an end of the second passage 160, at pump 60, through valve 140. The cooling fluid may alternatively be introduced before or after the fuel flows into the warmed fuel system 30. This cooling fluid may flow through the second passage 160 of the first conduit 80 from valve 140 toward vent 110. Such flowing of the cooling fluid may cool the first passage 150 and reduce any production of vapor gas.

In one exemplary embodiment, the cooling fluid is liquid nitrogen. The valve 140 may direct the liquid nitrogen into the second passage 160, from the optional coolant supply 145. The liquid nitrogen may be colder than the LNG flowing within the first passage 150 to cool the first passage 150 rapidly. Once a sufficient amount of liquid nitrogen passes through the first conduit 80, the fuel system 30 should be cooled to a degree sufficient that boiling no longer occurs, or occurs below an acceptable level, and the pump 60 is primed. Vent 110 is moveable to selectively vent and release the liquid nitrogen from the second passage 160 into the atmosphere. Liquid nitrogen is nonhazardous so that it may be released into the atmosphere.

After sufficient cooling has taken place, LNG may be released from the tank 40, through vent 110, to flow to pump 60 via the first passage 150. Alternatively, the liquid nitrogen may cool the system in the second passage 160 at the same time that the LNG flows within the first passage 150. In this latter situation, both the liquid nitrogen and LNG together may cool the first conduit 80.

In a second exemplary embodiment, the LNG from the first passage 150 may be selectively re-circulated to act as the cooling fluid within the second passage 160. Specifically, LNG flowing within the warmed first conduit 80 may be directed down branch C and into valve 140. The LNG may then be directed, by valve 140, through the second passage 160 of branch B. This re-circulated LNG may then flow within the second passage 160, toward vent 110, to cool the fuel system 30 and prime the pump 60, and then back into the tank 40. Although the LNG may boil and produce vapor gas during this cooling process, the vapor gas may enter the tank 40 through the second conduit 95, and migrate to the top of the tank 40. Alternatively, both the LNG flowing within the warmed first passage 150 and the re-circulated LNG flowing within the second passage 160 may cool the warmed first conduit 80 simultaneously. Once a sufficient amount of LNG has been re-circulated within the first conduit 80, the system should be cooled and the pump 60 primed. Vent 110 may be moveable to selectively release and vent the re-circulated LNG back into the tank 40.

In a third exemplary embodiment, a user may switch between use of liquid nitrogen and LNG as the cooling fluid. In particular, the user may move valve 140 between the first and second positions depending on which fluid the user desires to cool the first passage 150 with. Such switching of the system may, for example, permit a user to utilize liquid nitrogen while in a mechanic's shop, where liquid nitrogen is readily available, and change to LNG when in the field working, where liquid nitrogen may not be as accessible.

The present disclosure aims to provide a fuel system with at least two ways to prime and cool a fuel pump of a machine. The fuel system may help to reduce waste and expense associated with priming an inactive pump. Specifically, a user may cool the system with a cooling fluid and thereby reduce the amount of fuel wasted and boiled into vapor gas. Providing the option to use either liquid nitrogen or LNG as the cooling fluid may decrease the expense of priming a pump, as liquid nitrogen is cheaper than LNG.

The present disclosure may provide a system that is capable of safely venting to the atmosphere and thereby reduces emissions. Liquid nitrogen may be safely released into the atmosphere, but is not always available. Therefore, the present disclosure may allow a user to utilize LNG, when it is the only cooling fluid available, but switch to liquid nitrogen, a more environmentally favored coolant, when the user is not so limited.

It will be apparent to those skilled in the art that various modifications and variations can be made to the system of the present disclosure. Other embodiments of the system will be apparent to those skilled in the art from consideration of the specification and practice of the method and system disclosed herein. It is intended that the specification and examples be considered as exemplary only, with a true scope of the disclosure being indicated by the following claims and their equivalents.

What is claimed is:

1. A fuel priming system comprising:

a tank configured to hold liquefied natural gas;

a pump;

a first passage connecting the tank and the pump and configured to pass liquefied natural gas from the tank to the pump;

a second passage configured to pass liquefied natural gas to cool the first passage, and a valve configured to selectively connect the first passage at the pump to the second passage, and to re-circulate the liquefied natural gas from the first passage into the second passage.

2. The fuel priming system of claim 1, wherein:

the second passage is further configured to selectively pass liquid nitrogen toward the tank.

3. The fuel priming system of claim 2, further including a vent configured to selectively release the liquid nitrogen from the second passage to the atmosphere or into the tank.

4. The fuel priming system of claim 3, further including a valve connected to the second passage at the pump and configured to selectively direct the liquid nitrogen, or another cooling fluid, into the second passage.

5. The fuel priming system of claim 1, further including wherein the first and second passages are coaxial.

6. A fuel priming system comprising:

a tank configured to hold a cryogenic fuel;

a pump;

a first passage connecting the tank and the pump; and a second passage configured to hold a cooling fluid and located to cool the first passage, wherein:

the first passage includes a vertical section and an inclined section; and the fuel priming system further includes a vapor dome collector in fluid communication with the first passage and located at an end of the inclined section that is gravitationally higher than an outlet of the vertical section and the pump.

7. The fuel priming system of claim 6, further including a conduit extending from the vapor dome collector to a top portion of the tank.

8. A method of cooling a pump comprising:

releasing fuel from a tank into a warmed passage;

allowing fuel to expand within the warmed passage;

directing expanding fuel from the warmed passage toward a pump;

directing cooling fluid into a second passage to cool the warmed passage; and collecting vapor gas that is produced from the expanding fuel in the warmed passage in a vapor dome collector connected at an end of an inclined section of the warmed passage that is gravitationally higher than an outlet of a vertical section of the warmed passage and the pump.

9. The method of claim 8, wherein the fuel is liquefied natural gas and the cooling fluid is liquid nitrogen.

10. The method of claim 9, further including releasing the liquid nitrogen into the atmosphere, after passing it through the second passage.

11. The method of claim 10, wherein directing cooling fluid into the second passage includes selectively directing the liquid nitrogen into an end of the second passage at the pump.

12. The method of claim 8, wherein the fuel is liquefied natural gas and the cooling fluid is liquefied natural gas.

13. The method of claim 12, further including selectively re-circulating the liquefied natural gas from the warmed passage into the second passage.

14. The method of claim 13, wherein the liquefied natural gas in the warmed passage and the liquefied natural gas in the second passage both cool the warmed passage.

15. The method of claim 8, wherein the fuel is released from the tank and flows into the warmed passage by gravity.

16. The method of claim 8, further including:

collecting gas vapor from the expanding fuel; and directing the gas vapor into the tank.

17. A fuel system for a machine having an engine comprising:

a tank configured to hold liquefied natural gas for the engine;

a pump configured to pressurize and direct the liquefied natural gas into the engine;

a first passage located between the tank and the pump;

a second passage coaxial with the first passage;

a vent connected to the second passage at the tank and moveable to vent cooling fluid from the second passage to the atmosphere;

a valve connected to the second passage at the pump and moveable to either redirect fuel from the first passage into the second passage or to direct cooling fluid into the second passage;

the first passage including a vertical section and an inclined section; and a vapor dome collector in fluid communication with the first passage and located at an end of the inclined section that is gravitationally higher than an outlet of the vertical section and the pump.

* * * * *